US007275843B2

(12) United States Patent
Mier-Langner et al.

(10) Patent No.: US 7,275,843 B2
(45) Date of Patent: Oct. 2, 2007

(54) PAR TRACK LIGHT WITH INTERNAL WIRE WAY

(75) Inventors: Alejandro Mier-Langner, Providence, RI (US); James E. Kuchar, Fall River, MA (US); Robert S. Gosnell, Scituate, MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 37 days.

(21) Appl. No.: 11/198,057

(22) Filed: Aug. 5, 2005

(65) Prior Publication Data

US 2007/0030687 A1 Feb. 8, 2007

(51) Int. Cl.
*F21S 8/06* (2006.01)

(52) U.S. Cl. ..... 362/404; 362/648; 362/285; 362/287

(58) Field of Classification Search ..... 362/647, 362/648, 649, 404, 147, 287, 368, 285; 439/122, 439/110, 287
See application file for complete search history.

(56) References Cited

U.S. PATENT DOCUMENTS

| | | | | |
|---|---|---|---|---|
| 5,788,518 | A * | 8/1998 | Wachter et al. | 439/121 |
| 6,079,992 | A * | 6/2000 | Kuchar et al. | 439/122 |
| 6,588,920 | B2 * | 7/2003 | Agro | 362/287 |
| 2003/0081422 | A1 * | 5/2003 | Ward | 362/428 |
| 2005/0078482 | A1 * | 4/2005 | Bartlett | 362/285 |
| 2006/0039168 | A1 * | 2/2006 | Mier-Langner et al. | 362/648 |

* cited by examiner

*Primary Examiner*—Thomas M. Sember
(74) *Attorney, Agent, or Firm*—John F. Salazar; Middleton Reutlinger

(57) ABSTRACT

Disclosed is a PAR track light fixture having an internal wire way. The PAR track light fixture has an opened ring design separating outer ring which peripherally surrounds the outer edge of the PAR lamp. The ring is separated from the socket cup thereby exposing an outer reflector section of the PAR lamp. In combination with the open ring design of the present invention, it is an internal wire way which encloses all electrical conductivity from the track connector through a stem or blade and supporting arc sections to the socket cup and lamp.

10 Claims, 5 Drawing Sheets

PAR TRACK LIGHT WITH INTERNAL WIRE WAY

BACKGROUND OF THE INVENTION

The present invention relates to track light fixtures and more particularly to track light fixtures which utilize PAR lamps wherein a portion of the outside reflector of the PAR lamp is exposed and wherein the electrical connection between the track and the lamp is mained internal to the track light fixture.

DETAILED DESCRIPTION OF THE EMBODIMENTS

Figure 1:
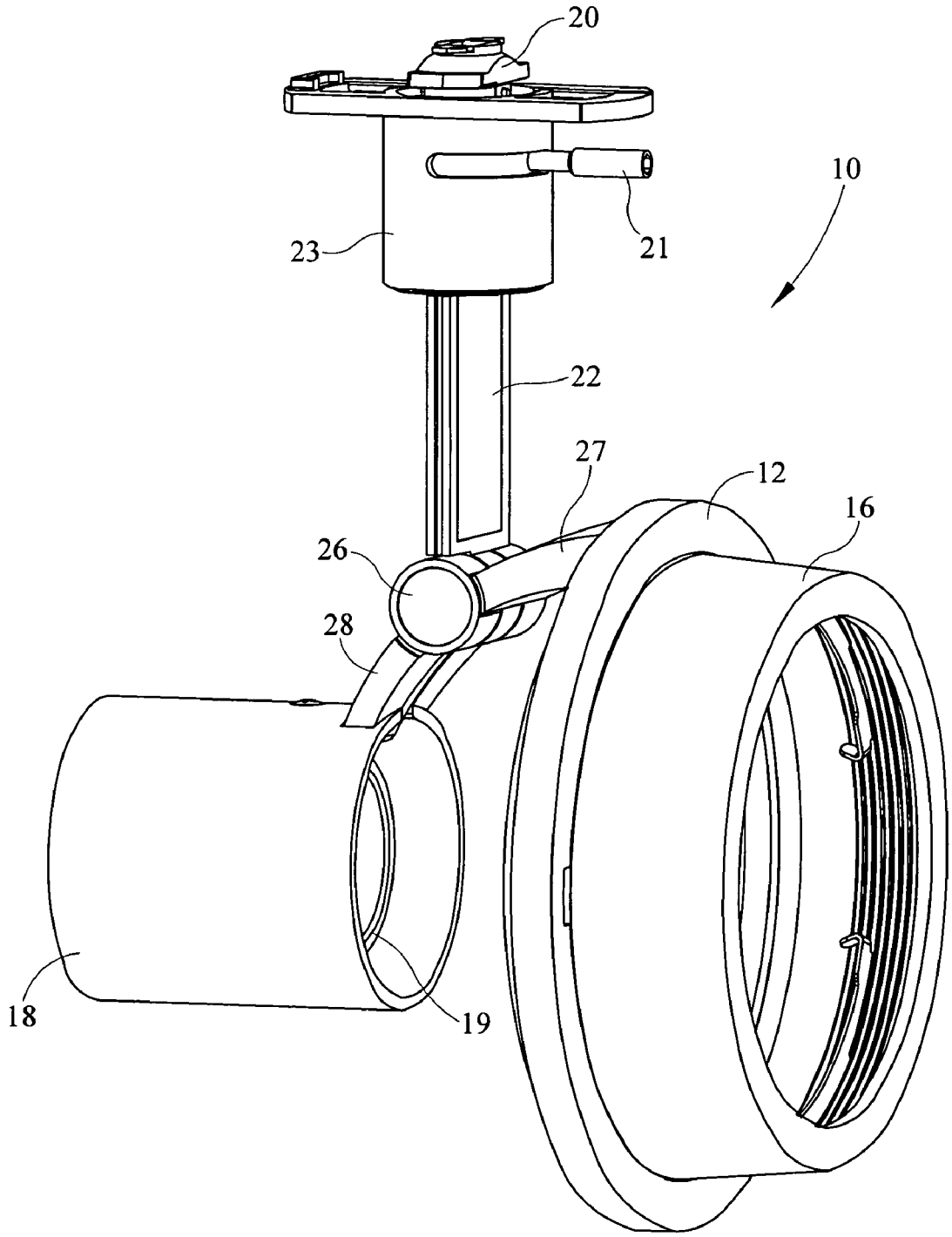
FIG. 1 is a perspective view of the PAR track light fixture with internal wire way of the present invention.
Figure 2:
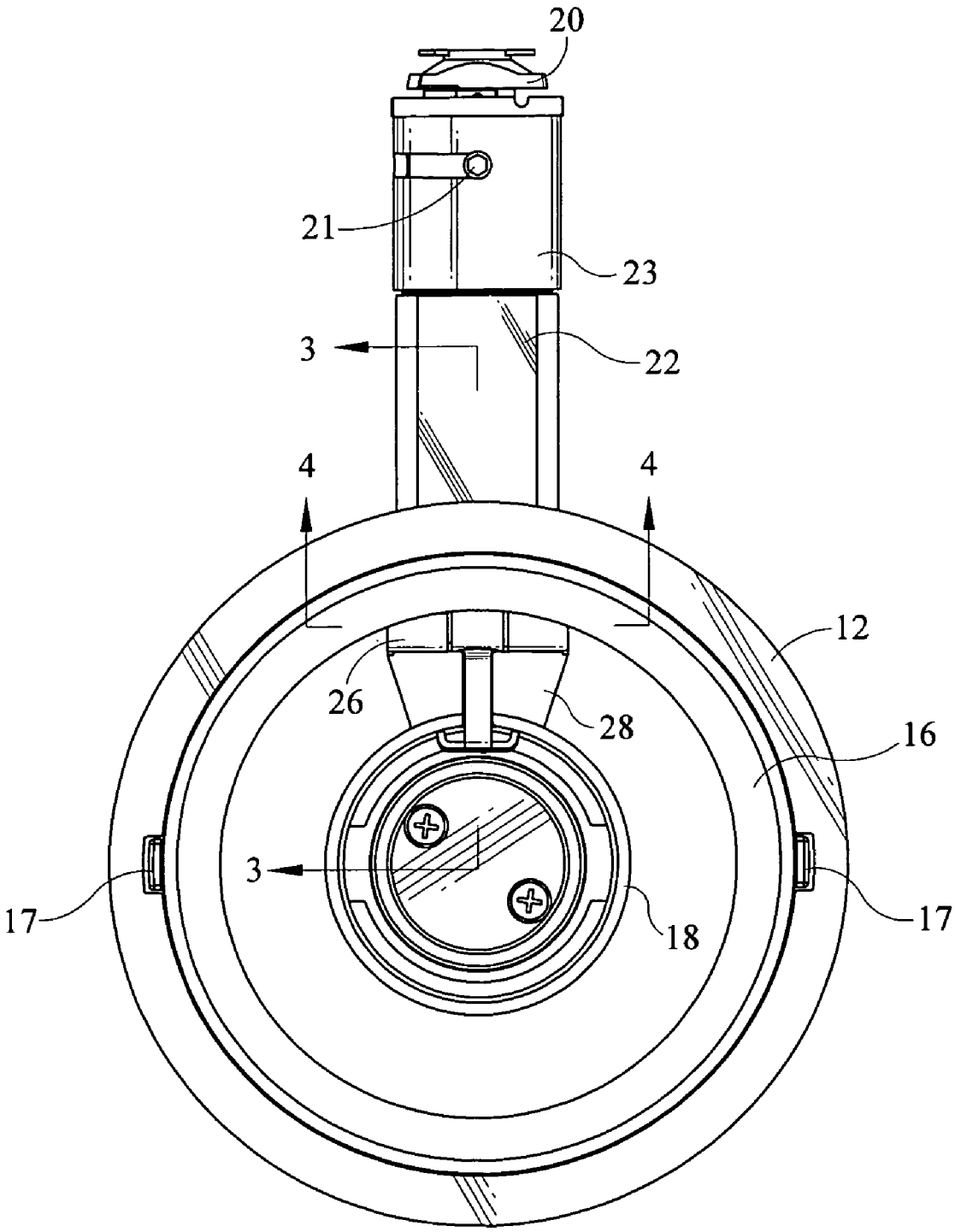
FIG. 2 is a front view of the PAR track light fixture with internal wire way of the present invention.

The PAR track light fixture with internal wire way 10 of the present invention is generally depicted in FIG. 1. As is shown, the PAR track light fixture has a track connector 20 which electrically connects the light fixture with a powerized track lighting system. The track connector 20 is operable to affix directly to the track via the connector activator 21 which is rotatably held within hub 23. The PAR track light fixture 10 of the present invention is supported by a blade or stem 22 depending from the hub and which internally contains a wire way for electrical connection between the track connector and the lamp cup 19. The PAR track light fixture of the present invention has a completely internal wire way extending from the track connector to the lamp cup so that there are no external wires while also having an open ring 12 thereby exposing the exterior reflective portion of the PAR lamp supported in the lamp cup 19 and socket cup 18. Thus, even with the PAR lamp installed and a support ring extending around an outer peripheral edge of the PAR lamp while exposing the exterior reflector portion of the PAR lamp, no wires are exposed from the track connector to the lamp cup 19 as an internal wire way is provided through a rotating hinge 26 and arc support arm 28.

In general, PAR track light fixtures with outer support rings 12 as are described, are desirable in that an external portion of the PAR lamp is exposed which is aesthetically pleasing to the consumer and which provides positive design characteristics. The support ring 12 is provided and affixed to the stem 22 via a first arc section 27 which is connected to the rotation hinge 26 below the stem 22. Second arc section 28 connects the stem 22 and rotation hinge 26 to the socket cup 18 allowing the socket cup 18 to be separate non-integral with the support ring, only connected by the arc sections, thereby exposing between the socket cup 18 and the support ring 12 an outer shiny reflector surface of the PAR lamp. The support ring 12 affixed at the distal end of the first arc section 27 is provided for both an attachment area or surface to removably attach an accessory ring 16 while also providing the dual function of covering the outer peripheral edge of the PAR lamp.

Figure 3:
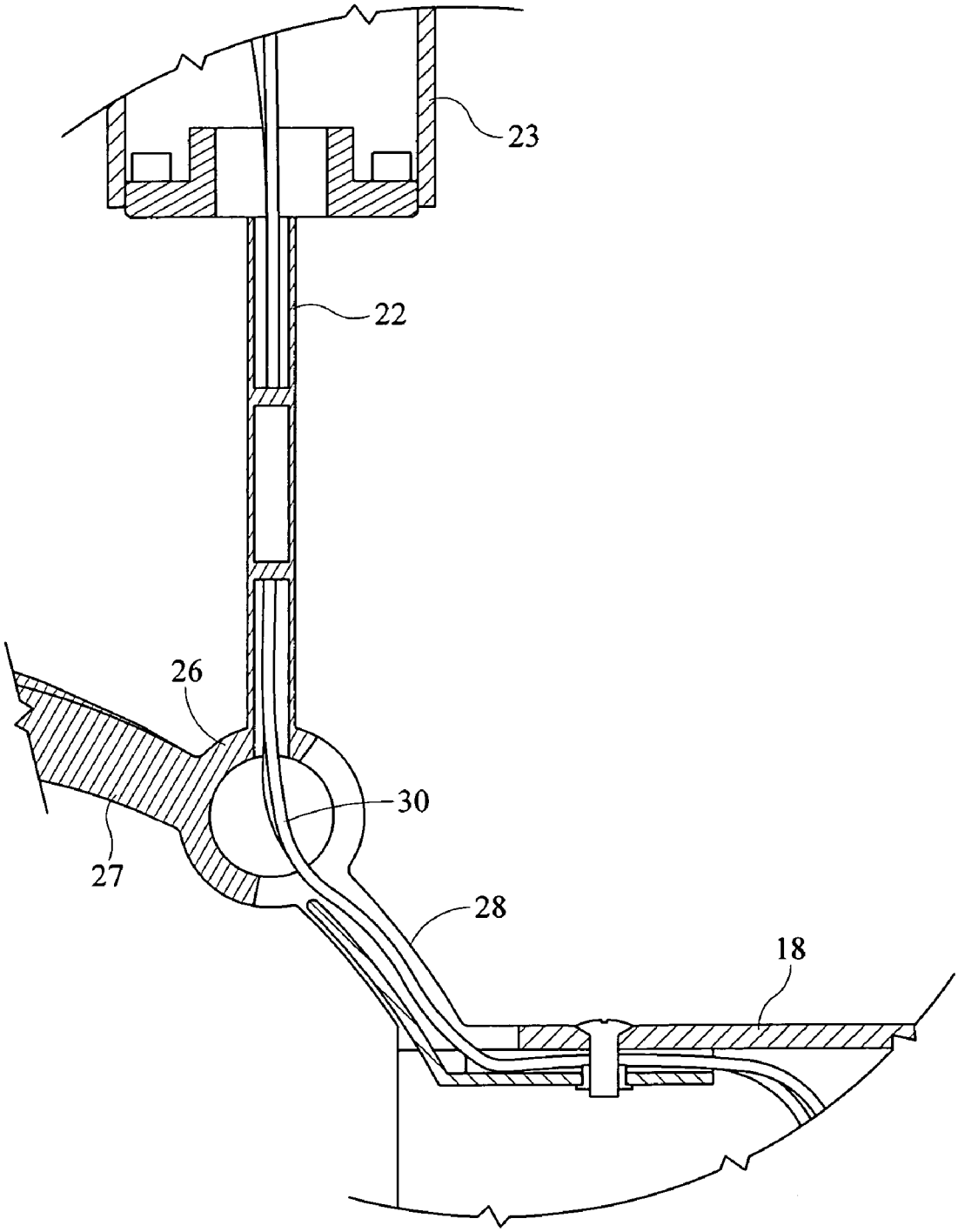
FIG. 3 is a side sectional view of the hinge and stem portion of the PAR track light fixture with internal wire way of the present invention.
Figure 5:
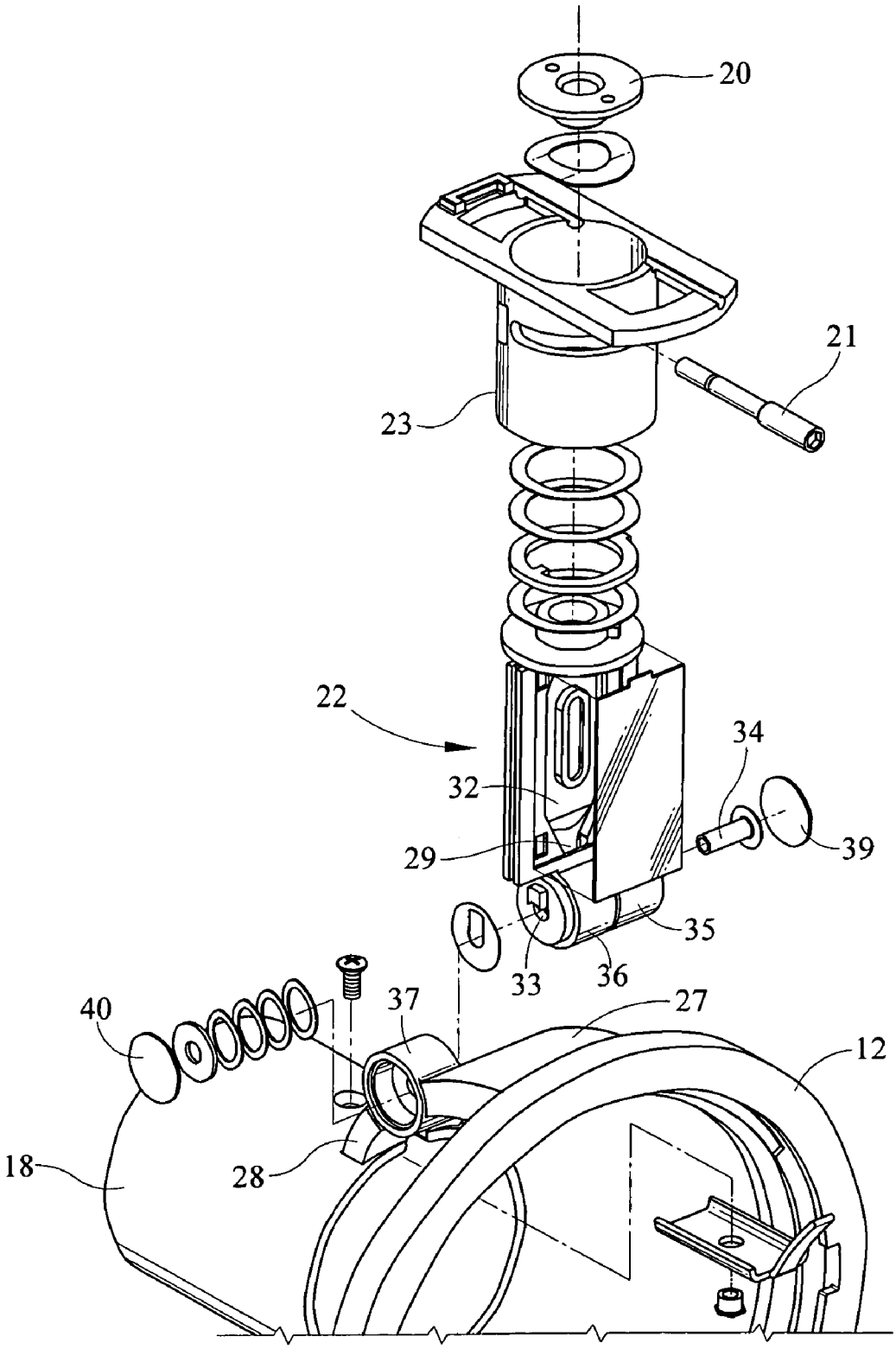

A further benefit of having the open ring with first arc support arm sections 27 and second arm support arm sections 28 joining the socket cup or husk 18 to the ring 12 is that the accessory ring 16 provided thereon can position lens and other filtering accessories directly adjacent to the outer surface of the PAR lamp while maintaining exposure of the outer reflector of the PAR lamp between the socket cup 18 and ring 12. An open ring PAR track light fixture 10 as is disclosed provides both an aesthetically pleasing and functional benefit by positioning internally a wire way extending from the track connector 20 all the way to the lamp cup 19 such that no wires are positioned external to the fixture or are visible. The wire way is such that rotational movement of the blade or stem 22 relative to the hub 23 about a vertical axis may be allowed while additionally allowing rotation by the rotation hinge 26 along a horizontal axis. An internal wire way may be provided through the hub 23, blade or stem 22, rotation hinge 26, second arc section 28 and into the socket cup 18. Further, rotation of the stem 22 about a vertical axis and rotation of the second arc section 28, socket cup 18 and support ring 12 may be allowed about a horizontal axis through rotation hinge 26. The wire way thus allows a wire or electrical conduit 30 to extend through the blade or stem 22 as is shown in FIG. 3, extending into the blade or stem 22 from the hub 23, through hinge 26 and internally through the second arc section 28 into the cup 18 as depicted. The wire provides line voltage to the lamp at the lamp cup 19 through an internal wire way via the conduit wires 30 through a first rotation hinge interposed between hub 23 and stem 22 about a vertical axis and a second rotation hinge between first arc section 27 and second arc section 28 and the stem hinge element 35, as shown in FIG. 5. Rotation about these two pivoting points is accomplished through internal wire way paths maintaining restrictive rotational movements thereby preventing binding or cutting of the wire at both rotation points. Further, the entire pathway of the wire 30 from the hub 23 to the cup 18 is internal while providing, in combination, a PAR open ring track light fixture exposing the outer reflector of the PAR lamp.

Figure 4:
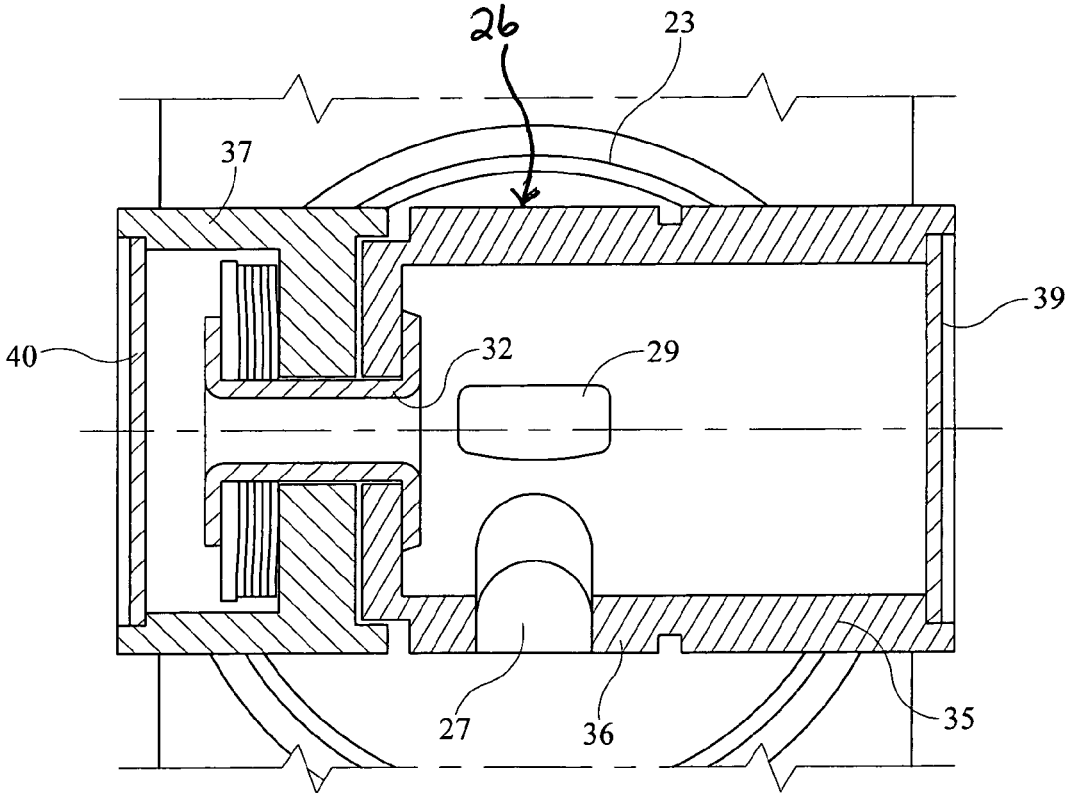
FIG. 4 is upward sectional view of the hinge and wire way for the PAR track light fixture with internal wire way of the present invention; and, FIG. 5 is an exploded view of the PAR track light fixture with internal wire way of the present invention.

Turning to FIG. 4, an upper view of the rotation hinge 26 is depicted wherein the hinge wire aperture 29 is shown through which the wires extend. The wires extend through the hinge wire aperture 29 and through the rotation hub with wire way 32 in order to enter into the arc hinge element 37 directly affixed to the cup 18. The arc hinge element 37 has an opened interior which is closed by first end cap 40 similar to the closing of an interior area defined by the stem hinge element 35 wherein second end cap 39 encloses the internal area containing wire from the hinge wire aperture 29. The wire may extend through the hinge wire aperture 29, through rotation hub with the wire way 32 and into the arc hinge element 37 thereby allowing the wire 30, as depicted in FIG. 3, to extend downward through the second arc section 28 and into the cup 18. In all positions, the wire 30 is maintained in an internal orientation.

As is also depicted, the wire 30 extends through two rotation points, the first being in the rotational connectivity point between blade or stem 22 and hub 23. The stem or blade 22 rotates about a vertical axis relative to the hub 23 and rotates with the wire 30 extending therethrough. Stops may be placed internal to the hub 23 to limit rotation and therefore prevent binding or fraying of the wires. Additionally, the wire extends through a second articulation point at hinge 26 wherein the second arc section 28 rotates relative to the stem hinge element 35 since the entire luminaire portion defined by the cup 18, second arc section 28, arc hinge element 37, first arc section 27, support ring 12 and other adjacent structure rotates about hinge pin 34 maintained internally of the hinge 26. Thus, stem hinge element 35 may remain stationary while the wire extends through wire way 33 into the arc hinge element 37 wire way via rotation hub wire way 32 depicted in FIG. 4 and into the second arc section 25 shown in FIG. 3. The wire 30 further extends through blade wire way 32 depicted in FIG. 5 which is maintained in substantially thin dimensions providing a thin structural support feature and also aiding in rotation of the blade or stem 22 about the hub 23. The blade or stem 22 is slightly wider than the width of the wire 30, as is shown in FIG. 3, to maintain the thin support structure as shown in the figures and the depth of the blade or stem 22 may be maintained less than half the width of the stem or significantly less, as shown. The blade wire way 32 allows the wires to be maintained in position between the dual rotation points at the hinge 26 and the hub 23.

The overall design of the PAR track light fixture with internal wire way of the present invention allows an external portion of the PAR lamp to be exposed, particularly the reflector portion, while maintaining a support ring and potentially an accessory ring in relationship to the outer peripheral edge of the PAR lamp in combination with the ability to position all electrical conduit and connectivity wires internal to the fixture thereby preventing visible exposure thereof. The internal wire way for a PAR track light fixture of the present invention may be combined with multiple styles of track fixtures including multiple PAR lamps, such as PAR 20, PAR 30, PAR 38 or other various sizes. Other modifications may be incorporated in the design disclosed herewith in the drawings, in the description hereof as well as the disclosure contained in the appended claims. Such modifications fall within the teachings hereof.

We claim:

1. A PAR track light fixture having an internal wire way, comprising:

a track connector removably affixable to a track;

a stem extending downward from said track connector, said stem rotatably connected to said track connector;

a rotation hinge affixed at a lower end of said stem, said rotation hinge having a first arc section extending upwardly and outwardly therefrom and a second arc section extending downwardly and outwardly therefrom, said first arc section affixed to an outer support ring, said second arc section affixed to a socket cup, said socket cup and said outer support ring separated in a non-integral relationship;

an internal wire way extending from said track connector through said stem, said rotation hinge and said second arc section thereby positioning electrical connectivity wires internally so as not to be seen.

2. The PAR track light fixture of claim 1 wherein a hub is positioned between an upper end of said stem and said track connector.

3. The PAR track light fixture of claim 1 wherein said support ring is an annular ring depending from an upper end of said first arc section and extends outwardly from said upper end of said first arc section.

4. The PAR track light fixture of claim 3 wherein said rotation hinge allows said socket cup, said second arc section, said first arc section and said support ring to rotate about a horizontal axis relative to said stem.

5. An opened ring PAR track light fixture, comprising:

a track adapter affixed to a downwardly depending stem at a first end of said stem;

an arc section affixed to an opposite end of said stem, said arc section having a first end and a second end, said first end of said arc section affixed to a socket cup, said second of said arc section having an outwardly and downwardly extending support ring, said support ring and said socket cup separated so as to expose an outer periphery of a PAR lamp maintained in said socket cup;

an internal wire way extending from said track adapter through said stem and said first arc section and into said socket cup, said internal wire way preventing electrical wires from being seen on the exterior of said track light fixture.

6. The PAR track light fixture of claim 5 wherein said stem rotates about a vertical axis and allows rotation about a horizontal axis at an opposite end.

7. A track light fixture having an internal wireway and exposing a portion of the lamp, comprising:

a track adapter rotatably connected to a blade support arm, said blade support arm rotationally hinged to an arc support, said arc support having a first end and a second end and separating a socket cup and an outer lamp ring, said first end of said arc support affixed to said socket cup, said second end of said arch support affixed to said lamp ring, said lamp ring encircling a lamp in said socket cup, an wire way extending through said blade support arm and at least a portion of said arc support through said first end of said arc support, wherein an external surface of a reflector of said lamp is exposed between said socket cup and said lamp ring and wherein said wire way prevents visual exposure of electrical conduit wires between said track adapter and said socket cup.

8. The track light fixture of claim 7 wherein said blade support arm rotationally attaches to said arch support at a hinge, said hinge having an arc hinge element and a blade support arm hinge element, said arch hinge element rotational relative to said blade support arm hinge element.

9. The track light fixture of claim 7 wherein said blade support arm affixes to a rotational hinge on said arch support forming a first arc section and a second arc section, said second arc section having said wireway.

10. The track light fixture of claim 9 wherein said rotational hinge has an internal rotation hub with wireway, said electrical conduit wire extending through said internal rotation hub.

* * * * *